US011376472B2

(12) United States Patent
Emadikotak et al.

(10) Patent No.: US 11,376,472 B2
(45) Date of Patent: Jul. 5, 2022

(54) AQUATIC SHOES PROVIDED WITH A FLOAT FOR WALKING IN WATER

(71) Applicants: Maxime Lahidjani Emadikotak, Bourges (FR); Darius Lahidjani Emadikotak, Bourges (FR)

(72) Inventors: Maxime Lahidjani Emadikotak, Bourges (FR); Darius Lahidjani Emadikotak, Bourges (FR)

( * ) Notice: Subject to any disclaimer, the term of this patent is extended or adjusted under 35 U.S.C. 154(b) by 0 days.

(21) Appl. No.: 16/629,509

(22) PCT Filed: Jul. 6, 2018

(86) PCT No.: PCT/IB2018/055013

§ 371 (c)(1),
(2) Date: Jan. 8, 2020

(87) PCT Pub. No.: WO2019/012397

PCT Pub. Date: Jan. 17, 2019

(65) Prior Publication Data

US 2020/0121991 A1 Apr. 23, 2020

(30) Foreign Application Priority Data

Jul. 8, 2017 (FR) ..... 1770735

(51) Int. Cl.
*A63B 31/11* (2006.01)

(52) U.S. Cl.
CPC ..... *A63B 31/11* (2013.01); *A63B 2031/112* (2013.01); *A63B 2225/605* (2013.01)

(58) Field of Classification Search
CPC ..... A63B 31/11; A63B 2031/112; A63B 2225/605
See application file for complete search history.

(56) References Cited

U.S. PATENT DOCUMENTS 1,627,521 A * 5/1927 Menschel ..... A63B 31/14 441/61
3,830,189 A * 8/1974 Yamanaka ..... B63B 34/56 441/62

(Continued)

FOREIGN PATENT DOCUMENTS

BE 643047 A 5/1964
CN 2102770 U 4/1992

(Continued)

OTHER PUBLICATIONS

International Search Report dated Nov. 19, 2018 for PCT/IB2018/055013.

*Primary Examiner* — S. Joseph Morano
*Assistant Examiner* — Jovon E Hayes
(74) *Attorney, Agent, or Firm* — Maxwell L. Minch; Maxwell L Minch Esq. PA

(57) ABSTRACT

The invention relates to an aquatic shoe consisting of a shoe body (1), a pair of wings (3) and floats (4, 4'), characterized in that the wings (3) are symmetrical, glued together, and linked to the shoe body (1), below the shoe, so as to constitute a part of the sole (2) of the shoe, and in that the float (4) is integrated below the wings (3), at the sole (2), so that one of its faces covers the sole (2), and in that the wings (3) are fixed by a pivot connection on both sides of the shoe, so that they descend when the foot ascends into the water and rise when the foot goes down into the water so that they return to their original position. The invention also relates to the use of footwear in the fields of recreational water and/or sport and in the paramedical fields. The shoe according to the invention can be used for the rehabilitation of animals.

16 Claims, 6 Drawing Sheets

(56) References Cited

U.S. PATENT DOCUMENTS

| | | | | |
|---|---|---|---|---|
| 7,736,208 | B2 * | 6/2010 | Bonis | A43B 5/08 441/64 |
| 7,828,615 | B2 * | 11/2010 | Bonis | A43B 5/08 441/61 |
| 2020/0121991 | A1 * | 4/2020 | Emadikotak | A63B 31/11 |

FOREIGN PATENT DOCUMENTS

| | | | | |
|---|---|---|---|---|
| GB | 255759 | A * | 7/1926 | A63B 31/11 |
| GB | 255759 | A | 7/1926 | |
| KR | 101369494 | B1 | 2/2014 | |

* cited by examiner

AQUATIC SHOES PROVIDED WITH A FLOAT FOR WALKING IN WATER

TECHNICAL FIELD OF THE INVENTION

The invention relates to the field of aquatic footwear. More particularly, the invention relates to an aquatic shoe with a float and wings to walk in the water, without laying feet on the ground, having the bust out of the water.

STATE OF THE PRIOR ART

Document US2016030810 A1 discloses a bathing device with retractable fins that can be adjusted for swimming or for walking. Said device comprises a left fin which is rotatably connected to the rear side of a left boot. The right wing as for it is rotatably connected to the rear side of a right shoe. The fins can rotate around the left and right rotational axes to left and right swim positions. In addition, the fins can be retracted from their left and right swim position to allow the user to walk naturally. With this device, the user can not walk in the water. It simply allows you to swim in the water and walk out of the water by retracting the fins.

Document CN20752562 relates to swimming shoes with water pedal. Each pedal type swim shoe includes a sole, a fin, buckling straps and a lace. In these shoes, the fin is arranged and movably connected to the periphery of the sole. A plurality of buckling belts are recessed on the swim shoe. The buckling belts are located on the inner/outer sides of the bottom surface of the boot and between the fingers. When swimming, the fins can move up and down with the movement of the legs and feet in the water. The shoes provide upward buoyancy to assist a non-swimmer to achieve the purpose of swimming. The shoes disclosed in this document are not designed to walk in water. The shoes allow a user to float in the water without being able to walk.

Also known is CN 101481007, which relates to a pair of sports shoes that can be used to walk freely on the water. Each shoe comprises a boot body, a main floating plate, a balance auxiliary floating propeller in which the main floating plate and the auxiliary floating prop attached to the sole have the main function of supporting a human to float on the surface of the foot. water and walk floating on the surface of the water. Sport shoes can satisfy the new demands of people who pursue fashion and play smartly on the water. This document does not disclose a shoe for walking in the water.

CN 204742812 describes a swimming shoe comprising, the upper, the fins, the sole and the tip. The upper is attached to the sole, the palms or fins are mounted at the front end of the sole. The shoe has a front-end equipped with legs to improve the speed of swimming. The shoe, object of this document is not designed to walk in water.

The nautical shoes known from the prior art are not suitable for non-swimmers and do not allow a person to walk, play and practice sports marches in the water. Today, we seek to treat or relieve leg problems by therapeutic movements by walking in the water, without putting foot on the ground and having the bust out of the water. However, there are no suitable ways for a non-swimmer adult to practice these walking movements in the water. Also for practitioners and caregivers, it is necessary to have this device to help people who need these types of care like people with disabilities. The object of the present invention is to find a solution for walking in the water, playing and practicing sport without stepping on the ground and having the bust out of the water. In addition, this device will also be used as a therapeutic tool. This device will also be suitable for use by animals.

SUMMARY OF THE INVENTION

The invention aims to provide a solution for a walking shoe in the water. It aims in particular to provide an aquatic shoe consisting of a shoe body, a pair of wings and floats, characterized in that the wings are symmetrical, glued together, and linked to the shoe body from below, so to constitute a part of the sole of the shoe, or on each side of the shoe, and in that the float is integrated below the wings, at the level of the sole, so that one of its faces covers the sole, and so that the wings descend when the foot goes up into the water and they rise when the foot goes down into the water so that they return to their original position.

According to particular features, the float is a solid shell, which can be filled with different materials or gases, said float being embedded under the wing at the sole.

According to particular features, the float has a geometric tetrahedron shape with three triangular faces.

According to a particular embodiment of the invention, the float has a flat shape with six faces. Said float being embedded in the sole and is an integral part of the sole. The shoe body includes an opening for the passage of a hoof. According to this same embodiment, the shoe body is molded in the shape of a boot and further comprises a strap for holding the paw of an animal.

According to particular features, the wings are made with a rigid material and are fixed on the sides of the shoe body by means of a hinge or any other means for said wings to rotate.

Advantageously, the wings are made of silicone or plastic, with grooves at the shoe body, so that the flexibility of the wing allows it to go up or down depending on the force of the water induced by the movement of the foot. The shoe body may be made of carbon fiber or glass, silicone, or plastic.

Indeed, it is possible to use materials such as carbon fiber or glass, silicone or ink plastic for the manufacture of the shoe according to the present invention.

Preferably, the wings are curved, with a rim gradually curved from the edge of the wings to the front where it is accentuated to form a beak, to improve the speed of advance.

According to particular features, the water shoe comprises a second pair of wings removably attached to the first pair of wings, via fastening means, to increase the width of the wings, said fastening means being clips, rails or any other fastening means that the skilled person deems necessary for the realization of the present invention.

According to a particular embodiment of the invention, the aquatic shoe comprises at least four fins placed by two thus connecting the ends of the wings to the float.

According to a particular embodiment of the invention, the water shoe comprises several holes on one side of the shoe body.

According to a particular embodiment of the invention, the boot body is constituted by at least two straps, said straps are fixed on the float, said float is so that it further comprises a cavity dug to a foot, in that at least four fins are fixed, two by two, on each side, below the float, and in that the straps can be intertwined, gathering in sandal. According to this particular embodiment, the shoe body consists of a set of straps or strips intertwined type Spartan sandals.

In particular, the water shoe according to the present invention is in one piece and/or in several pieces, and it is manufactured by means of a molding, in case of manufacture by several pieces said pieces are fixed together by least one known fixation method.

In particular, the aquatic shoe according to the present invention is manufactured by a 3D printer, when the shoe is made of a material such as plastic.

The invention also relates to the use of the aquatic shoe according to the present invention in the paramedical field for the rehabilitation and/or for the education of babies, young children and the disabled in an aquatic environment or in the field veterinarian, for the rehabilitation and care of animals in an aquatic environment.

The invention also relates to the use of the aquatic shoe according to the present invention in the paramedical field for the rehabilitation and/or for the education of babies, young children and the disabled in an aquatic environment or in the field veterinarian, for the rehabilitation and care of animals in an aquatic environment.

The invention further relates to the use of the water shoe according to the present invention in the field of water recreation, sea trips, river, lake, pool, and in the field of sports or rescue at sea.

BRIEF DESCRIPTION OF THE FIGURES

Other features, details and advantages of the invention will emerge on reading the description which follows, with reference to the appended figures, which illustrate.

For clarity, identical or similar elements are identified by identical reference signs throughout the figures.

DETAILED DESCRIPTION OF AN EMBODIMENT

Figure 1:
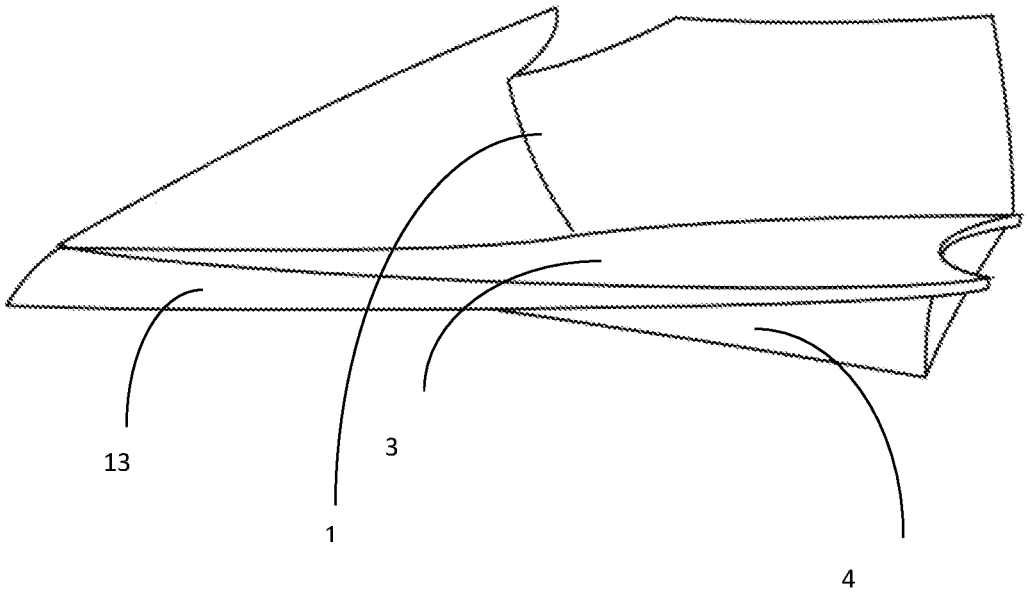
FIG. 1 shows a side view of the aquatic shoe according to the invention.

FIG. 1 shows a side view of an aquatic shoe according to the present invention. The aquatic shoe comprises a shoe body 1 and a first pair of wings 3. The wings 3 are symmetrical, they are glued together, and are linked to the shoe body 1, below the shoe. In this way, the wings constitute part of a sole 2 (not visible in the figure) of the boot 1. A float 4 is integrated below the wings 3, at the sole 2, so that of its faces covers the sole 2.

Indeed, the float 4 in the form of tetrahedron with triangular faces is integrated over approximately the entire surface of the sole 2. The wide side of the triangle is on the heel side of the shoe 1, in this way the pointed end of the triangle is on the front of the shoe to give an aerodynamic appearance to the float 4, to be able to advance more easily in the water. On both sides of the shoe 1 the wings 3 are fixed by pivot links. Said connections allowing the wings 3 flexibility of movement in the water.

Furthermore, the float 4 has been chosen to give more speed in the water. According to one embodiment of the invention the float is a solid shell with an aerodynamic shape that can be filled with different materials or gases. The float 4 can be recessed under the wings 3 at the level of the sole 2.

Figure 2:
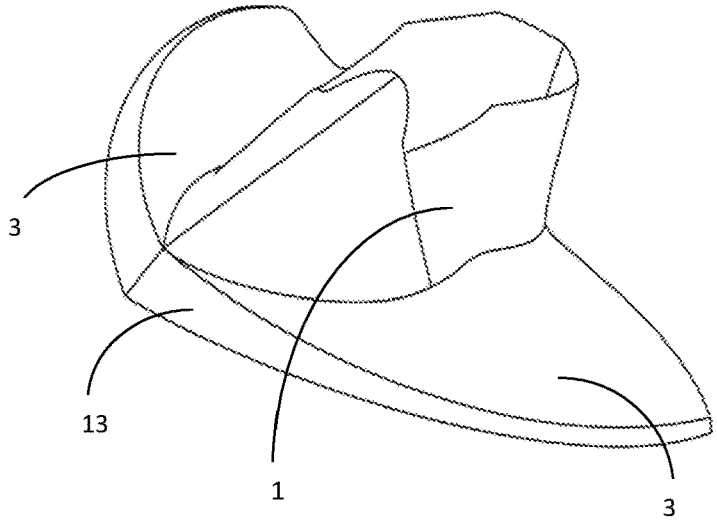
FIG. 2 shows the aquatic shoe with wings.

In FIG. 2, we note that the wings 3 are curved with a curved end 13 over the entire length of said wings. They are accentuated at the front, like a kind of beak. Indeed, the curved wings with a curved rim, allow to accentuate the force of the movement and thus to facilitate walking in the water. This configuration of the wings allows a user to walk in the water very easily without touching the bottom. This configuration is suitable for children in a nautical leisure center to play in a pool. A cuff with two positions: seated and on the back, can be used by a child swimmer or not, to walk in the water with the shoe according to the present invention. The shoe is also suitable for adults.

Figure 3:
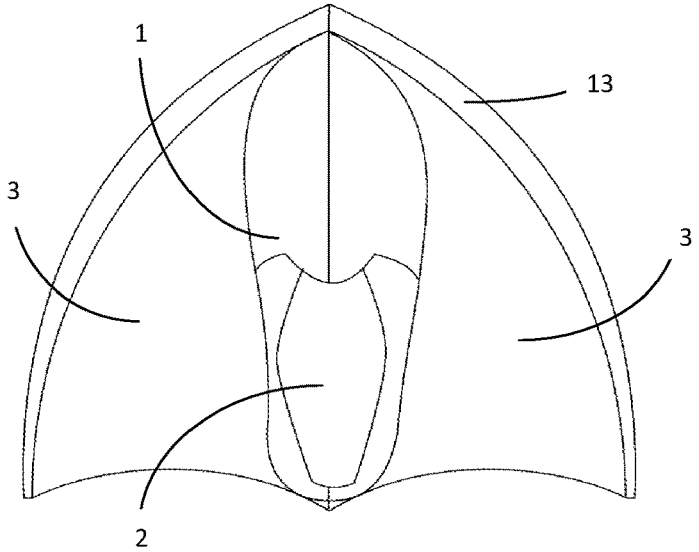
FIG. 3 is a top view of the shoe.

FIG. 3 shows a top view of the shoe. In this figure the part of the sole 2 is visible. The wings 3 are connected to the shoe body 1 and we see that their edges 13 are bent over the entire length of the shoe, the curvature is accentuated towards the front of the shoe as a kind of beak. The two wings 3 are placed each on one side of the shoe 1. Indeed, the curved wings with a curved edge and accentuated towards the front, allow to accentuate the force of the movement and thus to facilitate walking in the water.

Figure 4:
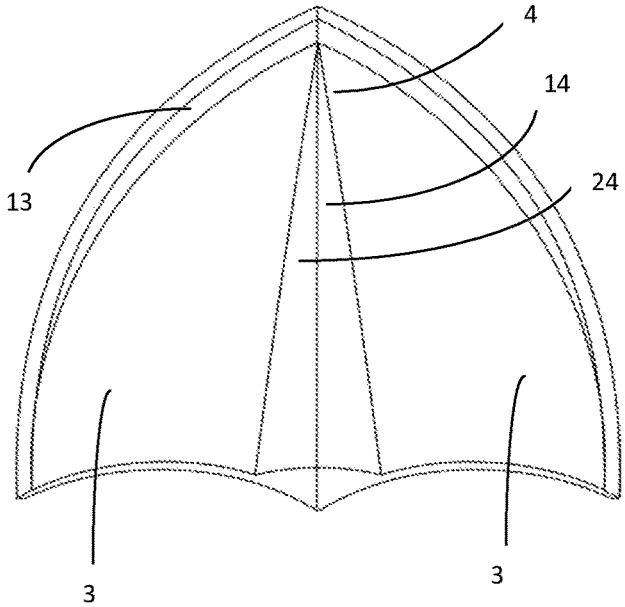
FIG. 4 shows a bottom view of the shoe.

FIG. 4 shows a bottom view of the shoe. The shoe body is not visible in this figure, we notice the float 4 with its triangular sides 14 and 24. The third triangular side 34 of the float 4 is placed on the sole 2 and is not visible in the figure. The pointed end of the triangular face of the float 4 is on the front of the shoe. In addition the two wings 3 with their curved edges are also visible in this figure.

Figure 5A:
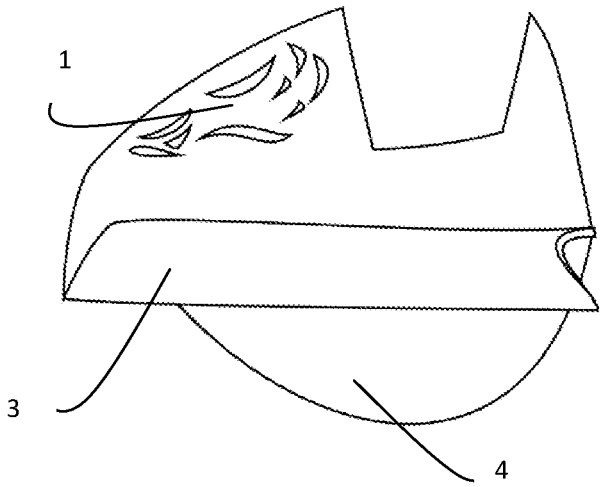
FIG. 5A shows a side view of the shoe in a particular fashion with holes on both sides of the shoe body.
Figure 5B:
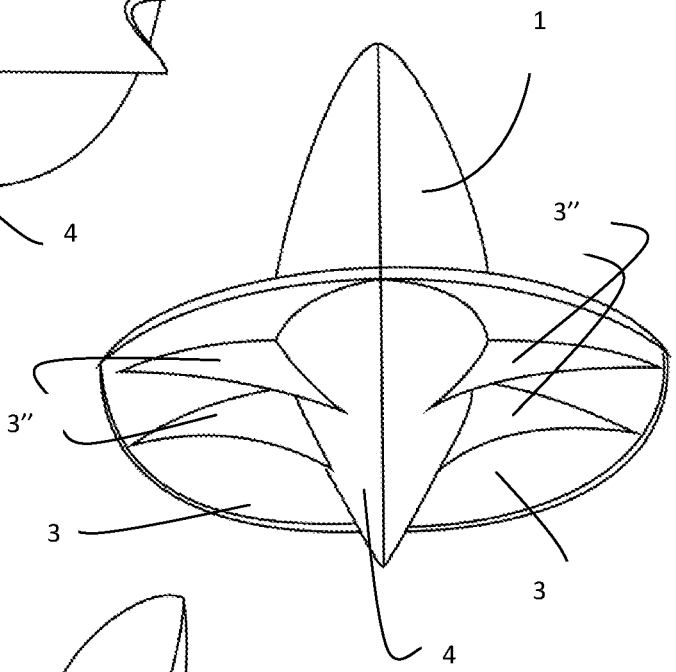
FIG. 5B shows a bottom view with four fins.
Figure 5C:
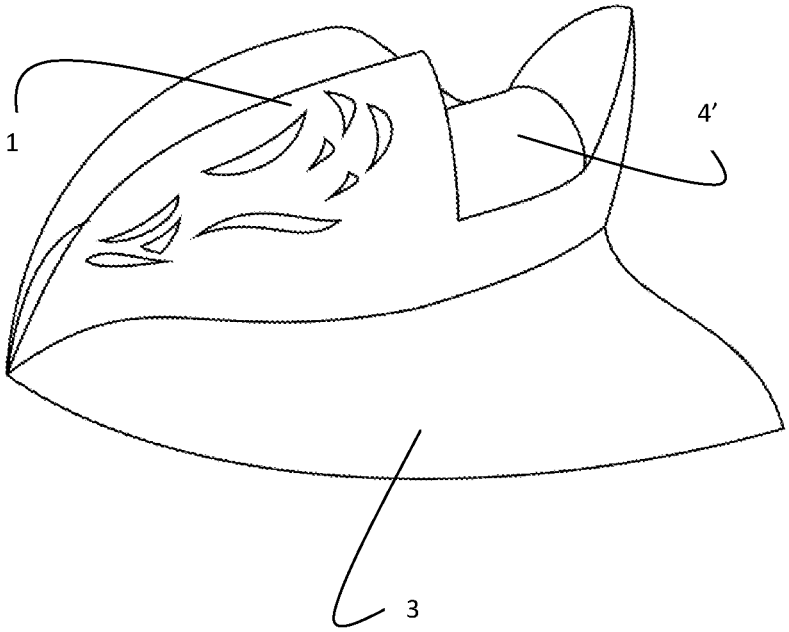
FIG. 5C shows a perspective view of the shoe.

FIG. 5A shows a side view of the shoe according to a particular mode. In this embodiment, an additional float 4' is integrated in the boot body 1, so that said float 4' takes place and function of the sole 2 as shown in FIG. 5C. 5B shows a bottom view with four fins 3", said fins 3" are fixed below the sole 2 by symmetry on each side and connects the ends of the wings 3 to the float 4 which is integrated with the sole 2 The positioning of these fins 3", as well as their thicknesses and their flexibilities are studied so that they bring even more stability to the water shoe according to the invention. According to this embodiment of the invention, on each side of the boot body 1, several holes of different sizes are made. Said holes may have different shapes. These holes provide a sensation of non-compression of the foot by the shoe since the water circulates slightly.

Figure 6A:
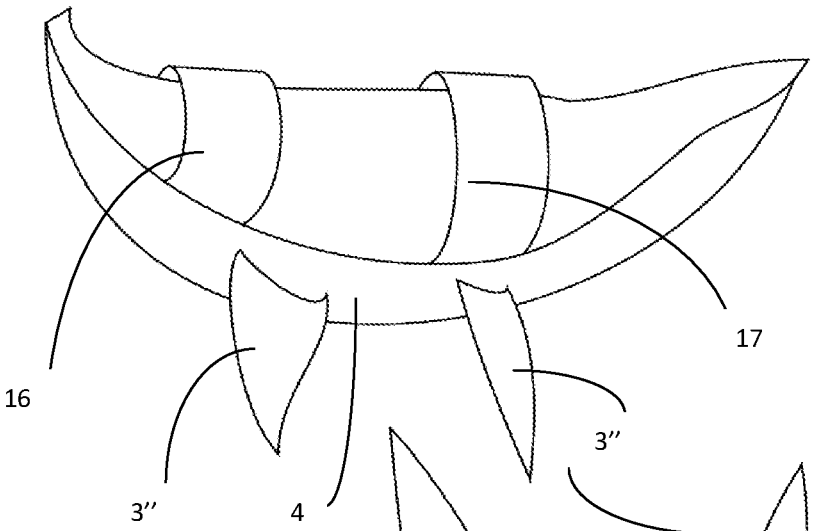
FIGS. 6A and 6B show the water shoe in a particular fashion with straps.
Figure 6B:
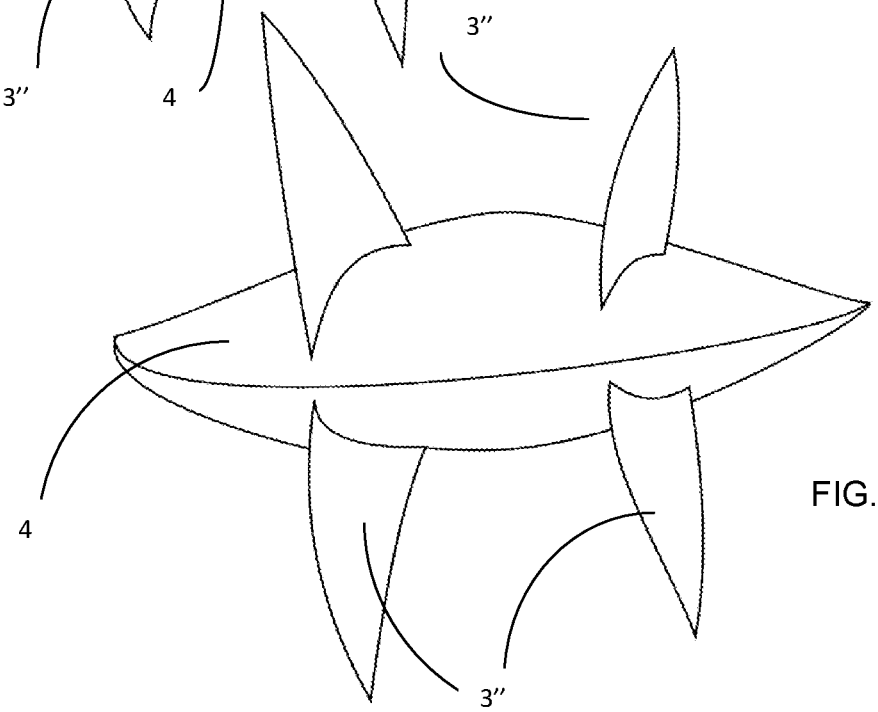

According to a particular embodiment of the embodiment of the invention shown in FIGS. 6A and 6B, the shoe body comprises two straps 16, 17. Said straps 16, 17, elastic, are fixed directly on the float 4. The float takes place and function of the sole. Four fins 3" are fixed below the float 4, the fins are placed symmetrically on each side of the float 4. The float further comprises an indentation dug a foot (not visible in FIGS. 6A and 6B). In addition, the straps or thongs can be crossed or intertwined. In other words the shoe body comprises a set of straps or thongs that are intertwined gathering in spartan sandals. Among the advantages of the shoe made according to this particular mode can be noted the ease of manufacture. Thus, the manufacture is more economical to achieve. In this embodiment the feet are a maximum in direct contact with the water.

Figure 7A:
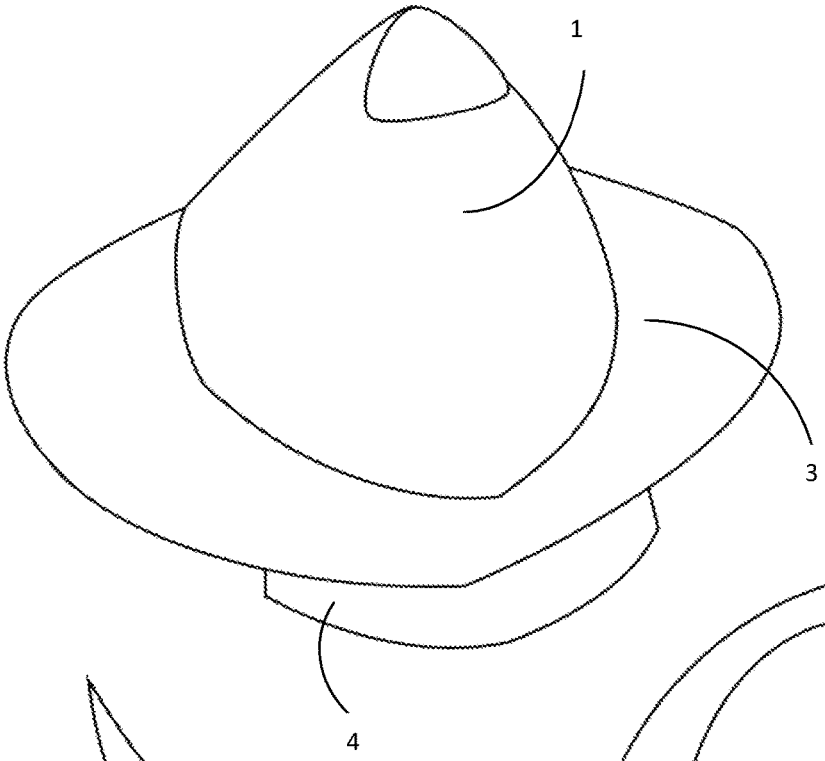
FIGS. 7A, 7B and 7C show views of the boot in a particular mode adapted to an animal.
Figure 7B:
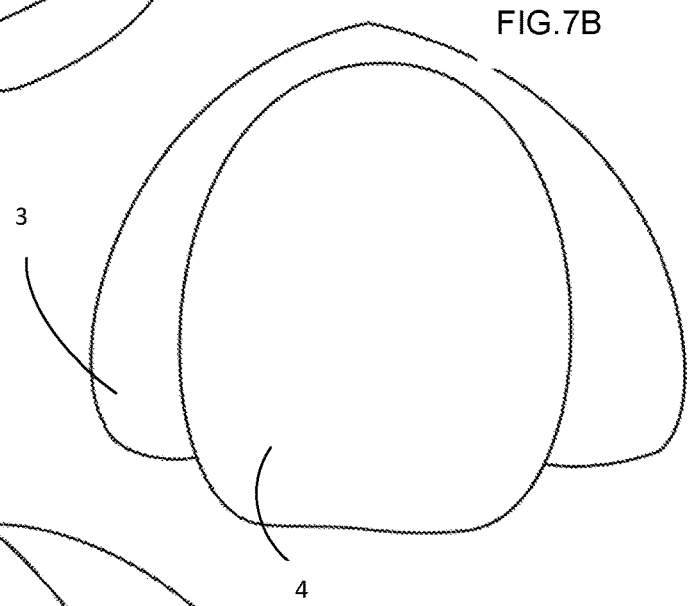
Figure 7C:
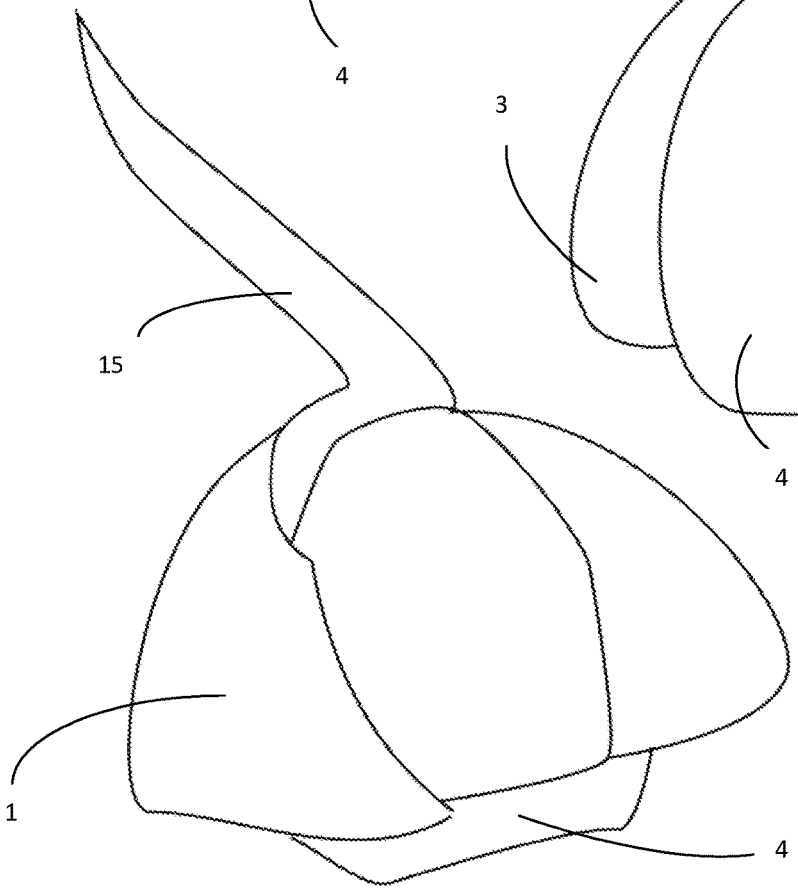

According to one embodiment of the invention shown in FIGS. 7A, 7B, 7C, the shoe body 1 has a particular shape compatible with the shape of the legs of an animal, such as a horse for example. The float 4 is made in a flat shape to suit the hooves of a horse and the shoe body further comprises an opening 15 for the passage of a shoe. The float 4 is integrated in the sole and is an integral part of the shoe. The wings 3 are attached to the shoe body 1. The shoe according to this embodiment is used for veterinarians, for the rehabilitation of animals and in particular for the rehabilitation of an animal after injury or other.

Figure 8:
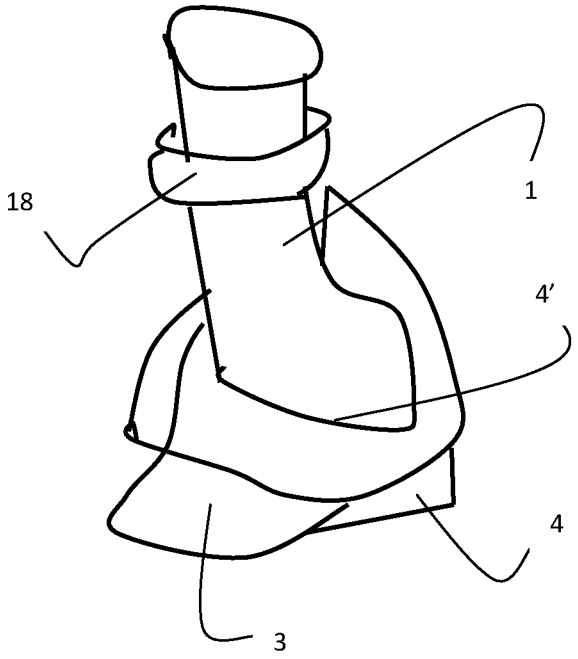
FIG. 8 shows a perspective view of an aquatic shoe, the boot-shaped shoe body.

In the case where the animal is a dog or a cat, the shoe body as shown in FIG. 8, is molded in the form of boot 1 thus including the float 4. The shoe body further comprises a strap 18 to hold the animal leg in place. Thus the wings 3 are fixed on each side of the float 4.

According to a preferred embodiment of the present invention, the wings 3 are composed of a flexible material. Indeed, the shoe and the wings are of the same flexible material and can be manufactured in one piece by molding. In general, it is possible to use materials such as carbon fiber or glass, silicone or plastic for the manufacture of the shoe according to the present invention.

The wings are made to rotate when the user walks in the water. For this at the shoe body 1 at the point of connection of the wings to the shoe there are grooves, allowing the wings to be pivoting. Indeed, the silicone or plastic material and the grooves at the binding with the boot body allow the wings to rotate, descend when the foot goes up and rise when the foot down into the water so that they come back to their initial position.

According to a particular embodiment of the invention, the wings are made of rigid material and can be connected to the shoe body by means of the hinges, so that they can pivot, during the movement of the feet of the shoe. user in the water. In this embodiment the shoe body and the wings can be manufactured separately.

According to one embodiment of the invention the wings are not curved, so as to form an angle of about 180° with the shoe body to suit athletes. Furthermore, in this embodiment, the wings are stiffer, thicker and wider to increase the difficulty of walking in the water and give athletes the satisfaction of sports marches.

In general, the shoe body is made of two materials, a rigid for the outer shell and a second, sub-envelope, flexible for the comfort of the foot.

According to a particular embodiment of the invention, the shoe comprises a second pair of wings 3'. The wings 3' can be removably attached to the wings 3 by fixing means. The fastening means are rails and/or clips. This embodiment makes it possible to increase the width of the wings without the body of the shoe being modified. Water shoes with wider wings may be suitable for high level athletes to increase, even more difficulty walking in water and to spend more energy.

The shoe according to the present invention is suitable for both children and adults. Moreover, it can be used in the field of water recreation, for walks in the sea, river, lake, pool. It can also be used in the field of sport and for rescue at sea. In addition, for non-swimmers, it can be provided a jersey equipped with a floater belt, so that the child does not feel distressed in water. Moreover for overweight people who wish to use the shoe to walk in the water, a belt can be provided, said belt must be in such a way as to conform to the shape of the body of the user.

The present invention allows the user by putting the shoes on the feet to lie on the back without flowing, without other equipment. In addition, there is the possibility of positioning the shoes under the arms, connected by a removable clip. There will also be the possibility of using the same configuration of the invention under the head, the flotation being ensured.

Advantageously, the aquatic shoe according to the present invention can be used in the paramedical field, for rehabilitation and leg problems. It can be used for the education of babies and young children in an aquatic environment. Young children swimmers or not, can use the nautical shoe, with a back armband with two positions: sitting or on the back or with a suitable vest.

Moreover, for ease of movement and effectiveness of the wings, they can be manufactured on each side of the shoe rigid material curved for a few centimeters, and then flexible material.

Another particular advantage of the water shoe according to the present invention is that it can be manufactured by a 3D printer when the wings are made of plastic. The silicone soft material is not suitable for manufacture by a 3D printer.

Many combinations can be envisaged without departing from the scope of the invention; the skilled person will choose one or the other depending on the economic, ergonomic, dimensional or other constraints that must be respected.

The invention claimed is:

1. A water shoe consisting of a shoe body (1), a pair of wings (3) and floats (4, 4'), characterized in that the wings (3) are symmetrical, glued together, and related to the shoe body (1), below the shoe, so as to constitute a part of the sole (2) of the shoe, and in that the float (4) is integrated below the wings (3), at the sole (2), so that one of its faces covers the sole (2), and in that the wings (3) are fixed by a pivot connection on both sides of the shoe, so that they descend when the foot goes up into the water and rise when the foot goes down into the water so that they return to their original position;

wherein said wings (3) are curved, with a curved rim (13) gradually to the edge of the wings (3) to the front where it is accentuated to form a beak.

2. The water shoe according to claim 1 characterized in that the float (4) is a solid shell, which can be filled with different materials or gases, said float being embedded under the wing (3), at the sole (2).

3. The water shoe according to claim 1 characterized in that the float (4) has a geometric tetrahedron shape with three triangular faces (14, 24, 34).

4. The water shoe according to claim 1 characterized in that the float (4) has a flat shape with six faces, said float (4) being embedded in the sole (2) and is an integral part of the sole (2), in that the shoe body comprises an opening (15) for the passage of a hoof, or in that the shoe body is molded in the shape of an ankle and further comprises a strap (18) to hold the paw of an animal in the shoe.

5. The water shoe according to claim 1 characterized in that the wings (3) are made of a rigid material and are fixed on the sides of the shoe body (1) by means of a hinge or other means allowing said wings to rotate.

6. The water shoe according to claim 1 characterized in that the wings (3) are made of silicone or plastic, with grooves in the shoe body, so that the flexibility of the wing allows it to mount or to descend according to the force of the water induced by the movement of the foot, and in that the shoe body can be made of carbon fiber or glass, silicone, or plastic.

7. The water shoe according to claim 1 characterized in that it comprises a second pair of wings (3') removably attached to the first pairs of wings (3), via fastening means, in order to increasing the width of the wings, said fixing means being clips, rails or any other fastening means.

8. The water shoe according to claim 1 characterized in that it further comprises at least four fins (3") placed by two on each side of the shoe connecting the ends of the wings (3) to the float (4).

9. The water shoe according to claim 1 characterized in that it comprises several holes (20) on one side of the shoe body (1), and said float (4') is integrated in the shoe body (1), so that said float (4') can be configured to act as the sole (2).

10. The water shoe according to claim 1 characterized in that the shoe body (1) consists of at least two straps (16, 17), said straps are fixed on the float (4).

11. The water shoe according to claim 1 characterized in that it is manufactured by a 3D printer when the wings are made of a material similar to plastic.

12. Use of the water shoe according to claim 1 in the paramedical field, for the rehabilitation and/or for the education of babies and young children in an aquatic environment or in the veterinary field, for rehabilitation racing animals in an aquatic environment.

13. Use of the water shoe according to claim 1 in the field of water recreation, walks in the sea, river, lake, pool, and in the field of sport or rescue at sea.

14. A water shoe consisting of a shoe body (1), a pair of wings (3) and floats (4, 4'), characterized in that the wings (3) are symmetrical, glued together, and related to the shoe body (1), below the shoe, so as to constitute a part of the sole (2) of the shoe, and in that the float (4) is integrated below the wings (3), at the sole (2), so that one of its faces covers the sole (2), and in that the wings (3) are fixed by a pivot connection on both sides of the shoe, so that they descend when the foot goes up into the water and rise when the foot goes down into the water so that they return to their original position, and a second pair of wings (3') removably attached to the first pairs of wings (3), via fastening means, in order to increasing the width of the wings, said fixing means being clips, rails or any other fastening means.

15. A water shoe consisting of a shoe body (1), a pair of wings (3) and floats (4, 4'), characterized in that the wings (3) are symmetrical, glued together, and related to the shoe body (1), below the shoe, so as to constitute a part of the sole (2) of the shoe, and in that the float (4) is integrated below the wings (3), at the sole (2), so that one of its faces covers the sole (2), and in that the wings (3) are fixed by a pivot connection on both sides of the shoe, so that they descend when the foot goes up into the water and rise when the foot goes down into the water so that they return to their original position, and at least four fins (3") placed by two on each side of the shoe connecting the ends of the wings (3) to the float (4).

16. A water shoe consisting of a shoe body (1), a pair of wings (3) and floats (4, 4'), characterized in that the wings (3) are symmetrical, glued together, and related to the shoe body (1), below the shoe, so as to constitute a part of the sole (2) of the shoe, and in that the float (4) is integrated below the wings (3), at the sole (2), so that one of its faces covers the sole (2), and in that the wings (3) are fixed by a pivot connection on both sides of the shoe, so that they descend when the foot goes up into the water and rise when the foot goes down into the water so that they return to their original position, wherein the wings are made of a material suitable for use in three-dimensional printing.

* * * * *